US007785378B2

(12) United States Patent
O'Rear

(10) Patent No.: US 7,785,378 B2
(45) Date of Patent: Aug. 31, 2010

(54) FISCHER-TROPSCH DERIVED TURBINE FUEL AND PROCESS FOR MAKING SAME

(75) Inventor: Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 632 days.

(21) Appl. No.: 11/556,342

(22) Filed: Nov. 3, 2006

(65) Prior Publication Data

US 2007/0220804 A1 Sep. 27, 2007

Related U.S. Application Data

(60) Provisional application No. 60/734,044, filed on Nov. 3, 2005.

(51) Int. Cl.
*C10L 1/04* (2006.01)

(52) U.S. Cl. ..... 44/452; 208/15; 208/17; 585/500; 585/639; 585/640

(58) Field of Classification Search ..... 585/500, 585/639–640; 44/452; 208/15
See application file for complete search history.

(56) References Cited

U.S. PATENT DOCUMENTS

| | | | | |
|---|---|---|---|---|
| 4,375,360 | A | 3/1983 | Washecheck et al. | |
| 4,568,663 | A | 2/1986 | Mauldin | |
| 4,919,786 | A | 4/1990 | Hamner et al. | |
| 5,766,274 | A | 6/1998 | Wittenbrink et al. | |
| 6,017,372 | A | 1/2000 | Berlowitz et al. | |
| 6,274,029 | B1 | 8/2001 | Wittenbrink et al. | |
| 6,309,432 | B1 | 10/2001 | Wittenbrink et al. | |
| 6,669,743 | B2 | 12/2003 | Wittenbrink et al. | |
| 6,846,402 | B2 | 1/2005 | Hemighaus et al. | |
| 6,858,048 | B1 | 2/2005 | Jimeson et al. | |
| 6,864,398 | B2 | 3/2005 | O'Rear | |
| 2002/0005009 | A1 * | 1/2002 | Wittenbrink et al. | 44/436 |
| 2005/0023188 | A1 | 2/2005 | Connor | |
| 2005/0165261 | A1 * | 7/2005 | Abazajian et al. | 585/1 |

FOREIGN PATENT DOCUMENTS

| | | | |
|---|---|---|---|
| EP | 0 321 303 | A2 | 6/1989 |
| EP | 0 635 557 | A1 | 1/1995 |
| EP | 1 015 530 | B1 | 6/2002 |
| WO | WO 96/18707 | | 6/1996 |
| WO | WO 97/14769 | | 4/1997 |
| WO | WO 98/35000 | | 8/1998 |
| WO | WO 98/50493 | | 11/1998 |
| WO | WO2006/088462 | A1 | 8/2006 |
| WO | WO2007/055935 | | 5/2007 |
| WO | WO2007/056238 | | 5/2007 |

OTHER PUBLICATIONS

World Jet Fuel Specifications, 2005. ExxonMobil Aviation International Ltd, Leatherhead, UK, 51 pgs.*

Eilers et al., The Shell Middle Distillate Synthesis Process (SMDS), Springer Science and Business Media, Prepared for presentation at the AIChE Spring National Meeting, Orlando, Florida, USA, Mar. 1990, pp. 253-270, Catalysis Letters 7, J.C. Baltzer A.G., Scientific Publishing Company.

US Army Scuffing Load Wear Test (Jan. 1, 1994), Wear Mechanism Evaluation and Measurement in Fuel-Lubricated Components, U.S. Dept of Commerce, Natl Technical Information Serv, Southwest Research Inst, San Antonio, TX. Belvoir Fuels and Lubricants Research Facility, Sep. 1994, ADA284870, pp. 139-151, www.NTIS.gov.

Lacey, Wear With Low-Lubricity Fuels, II. Correlation Between Wear Maps and Pump Components, 0043-1648/93/$6.00, Elsevier Sequoia, 1993, pp. 333-343.

Aviation and Other Gas Turbine Fuels, Kirk-Othmer Encyclopedia of Chemical Technology, Fourth Edition, vol. 3, Antibiotics to Batteries, A Wiley-Interscience Publication, John Wiley & Sons, D35, pp. 788-812.

Testerman, Memorandum for EQC (Dr. Mayfield), Subject—Request for Security and Policy Review, dated Mar. 1, 1996.

Curry-Hyde et al., Conversion of Natural Gas to Transportation Fuels Via the Shell Middle Distillate Synthesis Process (SMDS), Natural Gas Conversion II, Proceedings of the Third Natural Gas Conversion Symposium, Studies in Surface Science Catalysis 81, Jul. 4-9, 1993, pp. 43-71, vol. 81, Elsevier, Sydney.

Turbines Fuel, Aviation, Kerosene Type, Jet A-1, Ministry of Defence, Defence Standard, Nato Code: F-35, Joint Service Designation: Avtur, May 8, 1996, Reprinted Sep. 11, 1998 Incorporating Amendments 1, 2 and 3.

Tijm et al., The Markets for Shell Middle Distillate Synthesis Products, Alternate Energy '95, May 2-4, 1995, pp. 228-242, Vancouver, Canada.

Jahammir, Chain Length Effects in Boundary Lubrication, 0043-1648/85/$3.30, 1985, pp. 331-349, Elsevier Sequoia, Switzerland.

Vere, Dilution Restores Lubricity, Supplied by the British Library—"The world's knowledge" www.bl.uk, SAE Journal, Apr. 1970, pp. 42-43.

Kajdas, About an Anionic-Radical Concept of the Lubrication Mechanism of Alcohols, 0043-1648/87/$3.50, 1987, pp. 167-180, Elsevier Sequoia, The Netherlands.

Standard Specification for Aviation Turbine Fuels, ASTM Designation: D 1655, Rev C, 1996, pp. 1-10, American Society for Testing and Materials, ASTM International, West Conshohocken, PA.

Standard Test Method for Determining Water Separation Characteristics of Aviation Turbine Fuels by Portable Separometer, Designation: D 3948, Rev A, 1999, pp. 1-11, American Society for Testing and Materials, West Conshohocken, PA.

(Continued)

*Primary Examiner*—Robert J Hill, Jr.
*Assistant Examiner*—Brian McCaig
(74) *Attorney, Agent, or Firm*—A. Stephen Zavell

(57) ABSTRACT

The present invention is directed to a Fischer-Tropsch derived distillate suitable for use as a turbine fuel having a flash point 38° C. minimum measured by ASTM D 56 and a freeze point of −40° C. or less and further containing not less than 0.01 wt. % oxygen in each of 1-pentanol, 1-hexanol, and 1-heptanol and not more than about 0.01 wt. % oxygen in $C_{8+}$ linear alcohols. Preferably, the Fischer-Tropsch derived distillate will have a freeze point of at least −47° C., and more preferably the freeze point of the Fischer-Tropsch derived distillate will be not less than −50° C. All the wt. % oxygen amounts are on a water free basis.

20 Claims, No Drawings

OTHER PUBLICATIONS

Standard Test Method for Measurement of Lubricity of Aviation Turbine Fuels by the Ball-on-Cylinder Lubricity Evaluator (BOCLE), ASTM Designation: D 5001, 1990, pp. 1-6, American Society for Testing and Materials, Philadelphia, PA.

Standard Test Method for Evaluating Lubricity of Diesel Fuels by the Scuffing Load Ball-on-Cylinder Lubricity Evaluatior (SLBOCLE), ASTM Designation: D 6078, 1999, pp. 1-9, American Society for Testing and Materials, West Conshohocken, PA.

Shah et al., Fischer-Tropsch Wax Characterization and Upgrading, Final Report, U.S. Department of Commerce, National Technical Information Service, Springfield, VA, Jun. 6, 1988, DE88-014638, DOE/PC/80017-T1.

Toxicological Profile for Jet Fuels JP-4 and JP-7, U.S. Department of Health and Human Services, Jun. 1995.

Askwith et al., Chain Length of Additives in Relation to Lubricants in Thin Film and Boundary Lubrication, Proc. Royal Soc A291, 1966, pp. 500-518.

Standard Test Method for Pour Point of Petroleum Products, ASTM Designation: D 97-96a, Designation: 15/95, pp. 1-9, American Society for Testing and Materials, ASTM International.

* cited by examiner

FISCHER-TROPSCH DERIVED TURBINE FUEL AND PROCESS FOR MAKING SAME

FIELD OF THE INVENTION

The invention relates to a Fischer-Tropsch turbine fuel distillate product or turbine fuel blend component which also meets the specifications for jet fuel but with a lighter density than conventional jet fuel and a process for preparing the fuel.

BACKGROUND OF THE INVENTION

A turbine fuel refers to a fuel composition which may be burned in a turbine to provide power for various human activities. Turbines may be stationary, such as those used to generate electricity, or they may be used to power mobile platforms, such as providing power for ships. Turbine fuels meeting certain specifications may be used as jet fuel for airplanes.

Specifications for turbine fuel intended for use in jet engines are more stringent than those for fuels intended for use in turbines used to produce electricity. In particular, various grades of jet fuel have specifications which place limits on the freeze point. For example, Jet A has a freeze point of −40° C. or lower, Jet A1 has a freeze point of −47° C. or lower, and Jet B has a maximum freeze point of −50° C. or lower. While the specifications for a turbine fuel intended for use in generating electricity may differ from turbine fuel intended for use as jet fuel, it is more convenient to operate a refinery to produce only a single grade of product. Therefore, the most stringent specifications applicable for the intended use are relevant and must be met by the fuel. Where the specification density of conventional jet fuel needs to be maintained, these compositions of the invention are best used as blend stocks.

The Fischer-Tropsch process provides a way to convert a variety of hydrocarbonaceous resources into products usually provided by petroleum. These include jet fuel. In preparing hydrocarbons via the Fischer-Tropsch process, a hydrocarbonaceous resource, such as, for example, natural gas, coal, refinery fuel gas, tar sands, bitumen, crude oil, and fractions from crude oil, is first converted into synthesis gas which is a mixture comprising carbon monoxide and hydrogen. The syngas, in turn, is converted into synthetic hydrocarbonaceous compounds that have a predominantly linear structure, primarily n-paraffins, 1-alcohols, 1-olefins, and traces of other species. These hydrocarbonaceous species may be refined into various products, including turbine fuels.

European Patent Application No. 1015530, U.S. Patent Publication No. 2002/0005009A1 and U.S. Pat. Nos. 6,669,743; 6,309,432; and 5,766,274 describe the preparation of a Fischer-Tropsch derived product containing alcohols which is said to be useful as a jet fuel. However, this material has a density less than jet fuel specification. The presence of alcohols are claimed to improve the lubricity of the fuel. Unfortunately, the compositions taught in these documents employing the range of alcohols specific would fail to meet the freeze point specifications for jet fuel, and, consequently, they would not be suitable as commercial jet fuel. Furthermore, the "jet" fuels using the higher concentrations of alcohols would also fail other jet fuel specifications such as water separation. The present invention is directed to Fischer-Tropsch derived turbine fuel compositions which are able to meet the freeze point and water separation (MSEP) minimum of 85 specifications for jet, preferably, enhancing yields in the process.

Freeze point represents the temperature below which solid hydrocarbons may form in aviation turbine fuels. Freeze point is determined by ASTM D 2386 which measures the fuel temperature at which solid hydrocarbon crystals formed on cooling disappear when the temperature of the fuel begins to rise.

As used in this disclosure the phrase "Fischer-Tropsch derived" refers to a hydrocarbon stream in which a substantial portion, except for added hydrogen, is derived from a Fischer-Tropsch process regardless of subsequent processing steps. The feed for the creation of the "Fischer Tropsch derived" refers to products derived from any carbon source, for example natural gas, coal, refinery fuel gas, tar sands, oil shale, municipal waste, agricultural waste, forestry waste, wood, shale oil, bitumen, crude oil, and fractions from crude oil.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" are intended as a transition meaning the exclusion of all but the recited elements with the exception of only minor traces of impurities.

SUMMARY OF THE INVENTION

The present invention is directed to a Fischer-Tropsch derived distillate suitable for use as a turbine fuel having a flash point of 38° C. minimum measured by ASTM D 56 and a freeze point of −40° C. or less and further containing not less than 0.01 wt. % oxygen in each of 1-pentanol, 1-hexanol, and 1-heptanol and not more than about 0.01 wt. % oxygen in $C_{8+}$ linear alcohols. The upper wt. % oxygen limit of the alcohols is less than an amount which has the fuel failing the appropriate freeze point and/or other fuel specifications. Optionally two of the three alcohols can be used in a concentration not less than 0.03 wt. % oxygen for the two species, i.e., $C_5$ and $C_7$ or $C_5$ and $C_6$ or $C_6$ and $C_7$. Preferably, the Fischer-Tropsch derived distillate will have a freeze point of at least −47° C., and more preferably the freeze point of the Fischer-Tropsch derived distillate will be not less than −50° C. All the wt. % oxygen amounts are on a water free basis.

Lighter carbon number distributions for the turbine fuel or blend paraffins, e.g. $C_7$ or $C_8$ to less than $C_{14}$ can pass freeze point of −40° C. and −47° C. with $C_8$ and $C_{10}$ alcohols, provided the paraffins are predominately iso paraffins, e.g. greater than 90% iso paraffins. The average preferred range of $C_5$ to $C_7$ alcohols also preferentially pass an ASTM-3948 MSEP of 85 for water with broader carbon range distributions and lower iso to normal paraffin ratios.

The present invention is also directed to a process for preparing a Fischer-Tropsch derived turbine fuel preferably maximizing yield by permitting the $C_{8+}$ products to be upgraded and retaining the $C_{8-}$ products with alcohols in the lighter fraction. The process comprises (a) separating a Fischer-Tropsch condensate into a first and second fraction, wherein (i) said first fraction comprises not less than about 0.01 wt. % oxygen each of 1-pentanol, 1-hexanol, and 1-heptanol and not more than about 0.01 wt. % oxygen in $C_{8+}$ linear alcohols and (ii) said second fraction comprises $C_{8+}$ linear alcohols; (b) removing the $C_{8+}$ linear alcohols from at least a portion of said second fraction and recovering a treated heavy fraction substantially free of $C_{8+}$ linear alcohols; and (c) blending at least a portion of the first fraction of step a(i) and a portion of the treated heavy fraction of step (b) in the proper proportion to prepare a Fischer-Tropsch derived turbine fuel wherein the sum of the oxygenate content of the $C_5$-$C_7$ alcohols present are within the range of from about 0.01 wt. % oxygen and about 1 wt. % oxygen, the freeze point is not more than −40° C., and the flash point of 38° C. minimum measured by ASTM D 56. This flash point can generally be met where 121° C. (250° F.) is the minimum 5% point measured by ASTM D 2887. In carrying out the process of the invention a third fraction may be separated from the Fischer-Tropsch condensate in step (a) which contains $C_{4-}$ linear alcohols.

The present invention resides in the discovery that the presence of more than about 0.01 wt. % oxygen in $C_{8+}$ linear alcohols will significantly increase the freeze point of the composition rendering it unsuitable for use as a jet fuel. Further process the $C_{8+}$ fraction also can increase the yields since $C_8$ paraffins are suitable for use in jet fuel.

As used in this disclosure, the term "$C_{4-}$ linear alcohols" refers to linear alcohols containing 4 or less carbon atoms in the molecule, such as methanol, ethanol, 1-butanol, and 1-propanol. The term "$C_{8+}$ linear alcohols" refers to linear alcohols having 8 or more carbon atoms in the molecule, such as 1-octanol, 1-nonanol, 1-decanol, etc. Linear $C_5$-$C_7$ alcohols referred to in this disclosure are 1-pentanol, 1-hexanol, and 1-heptanol.

DETAILED DESCRIPTION OF THE INVENTION

The present invention is based upon the discovery that the presence of as little as 0.01 wt. % oxygen in $C_{8+}$ linear alcohols in a Fischer-Tropsch derived turbine fuel will raise the freeze point to an unacceptable temperature. Surprisingly, the presence of $C_5$-$C_7$ linear alcohols, more specifically 1-pentanol, 1-hexanol, and 1-heptanol, in the same fuel has a negligible effect on freeze point. Additionally the problem to be solved was to reduce the cost of preparation of jet fuel by reducing the severity of the hydrotreating operation which increases yield.

In the process of the invention the Fischer-Tropsch condensate is separated into at least two fractions, a first fraction comprising $C_7$ and lower alcohols and a heavier fraction. Preferably the lighter fraction has not less than about 0.01 wt. % oxygen each of 1-pentanol, 1-hexanol, and 1-heptanol and not more than about 0.01 wt. % oxygen in $C_{8+}$ linear alcohols and a second heavier fraction comprising $C_{8+}$ linear alcohols. A portion of the heavier second fraction which is intended to be blended back into the first fraction is treated to remove substantially all of the $C_{8+}$ linear alcohols present. Finally, the treated heavy second fraction is blended with at least a portion of the first fraction in a proportion calculated to yield a Fischer-Tropsch derived turbine fuel having a freeze point of not less than −40° C. In general, the sum of the oxygenate content of the $C_5$-$C_7$ alcohols present the Fischer-Tropsch derived turbine fuel will fall within the range of from about 0.01 wt. % oxygen and about 1 wt. % oxygen. Combinations of any two alcohols, i.e. $C_5$ and $C_6$ or $C_5$ and $C_7$ or $C_6$ and $C_7$ can be present in an amount from 0.01 wt. % oxygen, preferably 0.03 wt. % oxygen up to 1.0 wt. % oxygen. The fuel preferably should also have a flash point 38° C. minimum measured by ASTM D 56 and an MSEP as measured by ASTM D 3948 of 85 or higher. Unless blended with conventional petroleum feedstocks, the density will be less than the standards but still function effectively as a turbine and jet fuel.

When the iso to normal ratio can be selected to be about 90% iso paraffins, $C_8$ to $C_{10}$ 1-alcohols can also be used where an MSEP below 85 can be tolerated. When the turbine fuel or blend component must have a freeze point colder than −40° C. and also an MSEP above 85, the 1-alcohols of $C_5$, $C_6$, and $C_7$ are preferred.

The condensate recovered from Fischer-Tropsch operation will contain varying amounts of oxygenates. The majority of the oxygenates present in the condensate are in the form of alcohols; however, lesser amounts of ketones, aldehydes, carboxylic acids, and anhydrides may also be present. In order to prepare the heavy fraction which is substantially free of $C_{8+}$ linear alcohols, it is necessary to either remove the $C_{8+}$ linear alcohols or convert them into other hydrocarbons. There are a number of processes known to those skilled in the art which may be used to accomplish this step. These processes include, but are not necessarily limited to, hydrotreating, hydrocracking, hydroisomerization, dehydration, adsorption, absorption, or various combinations of these processes. As used in this disclosure, "substantially free of $C_{8+}$ linear alcohols" means that the distillate fraction contains $C_{8+}$ alcohols in an amount less than a concentration which increases the freezes point to warmer than the appropriate jet fuels specification or −40° C. for Jet A and −47° C. for Jet A1, etc.

Hydrocracking and hydrotreating are similar processes which differ primarily in the degree of severity. They may be referred to collectively in this disclosure as "hydroprocessing". In the process of the present invention hydrocracking and hydrotreating are intended primarily for the purpose of removing alcohols that are present in the Fischer-Tropsch distillate. "Hydrotreating" refers to a catalytic process, usually carried out in the presence of free hydrogen, in which the primary purpose when used to process conventional petroleum derived feed stocks is the removal of various metal contaminants, such as arsenic; heteroatoms, such as sulfur and nitrogen; and aromatics from the feed stock. In the present process, the primary process is to remove the alcohols and secondarily to saturate the olefins present. Generally, in hydrotreating operations cracking of the hydrocarbon molecules, i.e., breaking the larger hydrocarbon molecules into smaller hydrocarbon molecules is minimized. For the purpose of this discussion the term hydrotreating refers to a hydroprocessing operation in which the conversion is 20% or less. Conversion can be defined on the basis of the increase in the amount of material in the product relative to the feed, boiling below the 5% point of the feed as measured by ASTM D 2887. "Hydrocracking" refers to a catalytic process, usually carried out in the presence of free hydrogen, in which the cracking of the larger hydrocarbon molecules is a primary purpose of the operation. In contrast to hydrotreating, the conversion rate for hydrocracking, for the purpose of this disclosure. Shall be more than 20%. In the present invention, hydrocracking is used to remove the alcohols and to hydrogenate the olefin.

Catalysts used in carrying out hydrotreating and hydrocracking operations are well known in the art. See for example U.S. Pat. Nos. 4,347,121 and 4,810,357, the contents of which are hereby incorporated by reference in their entirety, for general descriptions of hydrotreating, hydrocracking, and of typical catalysts used in each of the processes. Suitable catalysts include noble metals from Group VIIIA (according to the 1975 rules of the International Union of Pure and Applied Chemistry), such as platinum or palladium on an alumina or siliceous matrix, and unsulfided Group VIIIA and Group VIB, such a nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, or more preferably or possibly, as sulfides when such compounds are readily formed from the particular metal involved. Preferred non-noble metal catalyst compositions contain in excess of about 5 wt. % oxygen, preferably about 5 to about 40 wt. % oxygen molybdenum and/or tungsten, and at least about 0.5, and generally about 1 to about 15 wt. % oxygen of nickel and/or cobalt determined as the corresponding oxides. Catalysts containing noble metals, such as platinum, contain in excess of 0.01% metal, preferably between 0.1 and 1.0% metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation. Although these components can be combined with the catalyst matrix as the sulfides, that is generally not preferred, as the sulfur compounds can interfere with the Fischer-Tropsch catalysts.

The matrix component can be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so called ultra stable zeolite Y and high structural silica: alumina ratio zeolite Y such as that described in U.S. Pat. Nos. 4,401,556; 4,820,402; and 5,059,567. Small crystal size zeolite Y, such as that described in U.S. Pat. No. 5,073,530 can also be used. Non-zeolitic molecular sieves which can be used include, for example, silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolitic molecular sieves can be found in U.S. Pat. No. 5,114,563 (SAPO) and U.S. Pat. No. 4,913,799 and the various references cited in U.S. Pat. No. 4,913,799. Mesoporous molecular sieves can also be used, for example the M41S family of materials as described in J. Am. Chem. Soc. 114:10834-10843 (1992)), MCM-41; U.S. Pat. Nos. 5,246,689; 5,198,203; and 5,334,368; and MCM-48 (Kresge et al., Nature 359:710 (1992)). Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia. silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification.

In performing the hydrocracking and/or hydrotreating operation, more than one catalyst type may be used in the reactor. The different catalyst types can be separated into layers or mixed.

Hydrocracking conditions have been well documented in the literature. In general, the overall LHSV is about 0.1 hr-1 to about 15.0 hr-1 (v/v), preferably from about 0.25 hr-1 to about 2.5 hr-1. The reaction pressure generally ranges from about 500 psig to about 3500 psig (about 10.4 MPa to about 24.2 MPa, preferably from about 1500 psig to about 5000 psig (about 3.5 MPa to about 34.5 MPa). Hydrogen consumption is typically from about 500 to about 2500 SCF per barrel of feed (89.1 to 445 m3 H2/m3 feed). Temperatures in the reactor will range from about 400° F. to about 950° F. (about 205° C. to about 510° C.), preferably ranging from about 650° F. to about 850° F. (about 340° C. to about 455° C.).

Typical hydrotreating conditions vary over a wide range. In general, the overall LHSV is about 0.5 to 5.0. The total pressure ranging from about 200 psig to about 2000 psig. Hydrogen recirculation rates are typically greater than 50 SCF/Bbl, and are preferably between 1000 and 5000 SCF/Bbl. Temperatures in the reactor will range from about 400° F. to about 800° F. (about 205° C. to about 425° C.).

"Hydroisomerization", also called simply "isomerization", is intended to improve the cold flow properties of the Fischer-Tropsch derived product by the selective addition of branching into the molecular structure. In the present invention, it may also be used to remove the alcohols. Isomerization ideally will achieve high conversion levels of the normal paraffins to iso-paraffins while at the same time minimizing the conversion by cracking. Isomerization operations suitable for use with the present invention typically uses a catalyst comprising an acidic component and may optionally contain an active metal component having hydrogenation activity. The acidic component of the catalysts preferably includes an intermediate pore SAPO, such as SAPO-11, SAPO-31, and SAPO-41, with SAPO-11 being particularly preferred. Intermediate pore zeolites, such as ZSM-22, ZSM-23, SSZ-32, ZSM-35, and ZSM-48, also may be used in carrying out the isomerization. Typical active metals include molybdenum, nickel, vanadium, cobalt, tungsten, zinc, platinum, and palladium. The metals platinum and palladium are especially preferred as the active metals, with platinum most commonly used.

The phrase "intermediate pore size", when used herein, refers to an effective pore aperture in the range of from about 4.0 to about 7.1. Angstrom when the porous inorganic oxide is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites such as faujasites and mordenites, they are able to differentiate between n-alkanes and slightly branched alkenes, and larger alkanes having, for example, quaternary carbon atoms. See U.S. Pat. No. 5,413,695. The term "SAPO" refers to a silicoaluminophosphate molecular sieve such as described in U.S. Pat. Nos. 4,440,871 and 5,208,005.

In preparing those catalysts containing a non-zeolitic molecular sieve and having an hydrogenation component, it is usually preferred that the metal be deposited on the catalyst using a non-aqueous method. Non-zeolitic molecular sieves include tetrahedrally-coordinated [AlO2 and PO2] oxide units which may optionally include silica. See U.S. Pat. No. 5,514,362. Catalysts containing non-zeolitic molecular sieves, particularly catalysts containing SAPO's, on which the metal has been deposited using a non-aqueous method have shown greater selectively and activity than those catalysts which have used an aqueous method to deposit the active metal. The non-aqueous deposition of active metals on non-zeolitic molecular sieves is taught in U.S. Pat. No. 5,939,349. In general, the process involves dissolving a compound of the active metal in a non-aqueous, non-reactive solvent and depositing it on the molecular sieve by ion exchange or impregnation.

The dehydration of alcohols may be accomplished by processing the feedstock over a catalyst, such as gamma alumina. During dehydration the alcohols are converted into olefins. The dehydration of alcohols to olefins is discussed in Chapter 5, "Dehydration" in *Catalytic Processes and Proven Cata-*

*lysts* by Charles L. Thomas, Academic Press, 1970. Another process is disclosed and completely incorporated herein by reference in U.S. Pat. No. 6,933,323.

Another method, also described in examples of U.S. Pat. No. 6,933,323, for removing the alcohols involves passing the condensate through an adsorption bed containing an adsorbent capable of adsorbing the alcohols. A satisfactory adsorbent may include a molecular sieve having low silica to alumina ratio. Large pore molecular sieves having a low silica to alumina ratio, particularly those molecular sieves characterized as having an FAU type of framework, are generally suitable for use as an adsorbent for alcohols and other oxygenates. Preferred FAU molecular sieves are X zeolites, with 13X zeolite being particularly preferred. As used herein, the term "FAU molecular sieve" refers to the IZA Structure Commission standard which includes both X and Y zeolites.

The synthesis of X-type zeolites is described in U.S. Pat. Nos. 2,882,244; 3,685,963; 5,370,879; 3,789,107 and 4,007,253 which are hereby incorporated herein by reference in their entirety. 13X Zeolite are a faujasite (FAU) type X zeolite. It has a low silica/alumina ratio and is comprised of silicon, aluminum and oxygen. The oxygen ring provides a cavity opening of 7.4 angstroms, but can adsorb molecules up to 10 angstroms. 13X zeolite have a Chemical Abstracts (CAS) number of [63231-69-6]. 13X zeolite are commercially available from several sources, including Aldrich Chemical Company and the Davison Division of W. R. Grace. Additionally the process as described in U.S. Pat. No. 6,933,323 can be used herein as noted above.

Preferably the Fischer-Tropsch turbine fuel of the invention will have an MSEP as measured by ASTM D 3948 of 85 or higher. ASTM D 3948 is a method for determining the water separation characteristics of aviation turbine fuels by use of a portable separometer. The MSEP rating of the fuel indicates the relative ease of coalescing water from a sample of the fuel. Flash point is the temperature to which the fuel must be heated to create sufficient fuel vapor above the surface of the liquid fuel for ignition to occur when exposed to an open flame. Flash point determined by ASTM D 56 and preferably is a minimum of 38° C.

The following examples highlight the problem to be solved by the realization of the effect of including $C_{8+}$ alcohols in turbine fuel and not being able to meet jet fuel freeze and water separator specifications. To evaluate the impact of adding alcohols to the water compatibility of Fischer-Tropsch derived hydrocarbons, the following experiments were performed.

EXAMPLE 1

A wax was obtained from a slurry bed Fischer Tropsch process operating with a supported cobalt catalyst (a non-shifting catalyst). This wax was first hydrotreated over a sulfided NiMo/Alumina catalyst to remove impurities and then hydroisomerized and hydrotreated and/or preferably hydrocracked. The product from the hydroisomerization and hydrotreating and/or preferably hydrocracking step was distilled to obtain a 250-550° F. produce with the following properties:

| Property | Value |
|---|---|
| Gravity, °API | 54.8 |
| Smoke Point, mm | 45 |
| Viscosity at ~20° C., cSt | 5.25 |

This product was then mixed with varying levels of primary linear alcohols and evaluated in ASTM D 3948 as shown in the next table.

| Blend No | Alcohol | Oxygen, ppm | Alcohol wt % | Alcohol wt % (actual) | Jet Fuel, wt % | D3948 results (2 replicates) |
|---|---|---|---|---|---|---|
| 1 | None | 0 | 0 | 0 | 100 | 98, 98 |
| 2 | n-C8 | 100 | 0.081 | 0.081 | 99.919 | 95, 91 |
| 3 | n-C8 | 1000 | 0.812 | 0.819 | 99.188 | 80, 86 |
| 4 | n-C8 | 5000 | 4.062 | 4.234 | 95.938 | 86, 83 |
| 5 | n-C10 | 100 | 0.099 | 0.099 | 99.901 | 95, 94 |
| 6 | n-C10 | 1000 | 0.987 | 0.997 | 99.013 | 82, 83 |
| 7 | n-C10 | 5000 | 4.936 | 5.192 | 95.064 | 82, 80 |

As can be seen by these experiments, samples with 1000 and 5000 ppm oxygen as n-$C_8$ can fail the ASTM D 3948 requirement of 85. Samples with 1000 and 5000 ppm oxygen as n-$C_{10}$ repeatedly fail the requirement of 85.

It shows that primary linear alcohols have about a 50° C. higher boiling range than the corresponding paraffin. In order to meet jet turbine fuel flash point specifications the initial point of jet fuels is 250° F. (120° C.) and needs a flash point minimum of 38° C. by ASTM D 56. This corresponds to a $C_8$ paraffin or a $C_5$ primary linear alcohol. Thus the alcohols in the turbine fuel can range from $C_5$ to $C_7$ or mixtures of any two of these alcohols.

EXAMPLE 2

In this example, a 600° F. end point Fischer Tropsch jet fuel with a high i/n ratio was prepared and tested.

A commercial sample of Fischer Tropsch $C_{-80}$ wax was obtained from Moore and Munger Co. It has an initial boiling point as determined by ASTM D 2887 of 790° F. and a boiling point at 5 wt. % of 856° F. It was hydrocracked in a single stage pilot plant at 669° F., 1.0 LHSV, 1000 psig. 10000 SCF/Bbl Hydrogen at about 90% conversion in a once-through operation (without recycle). A commercial sulfided hydrocracking catalyst was used. A 260-600° F. product with the following properties was recovered by distillation. This product contains over 2 wt. % n-$C_{14+}$ n-paraffins yet has a freeze point of −47.7° C.

| | |
|---|---|
| Density at 15° C., g/ml | 0.7626 |
| Sulfur, ppm | 0 |
| Viscosity at −20° C., cSt | 6.382 |
| Freeze Point, ° C. | −47.7 |
| Cloud Point, ° C. | −51. |
| Flash Point, ° C. | 54. |
| Smoke Point, mm | >45 |

| Hydrocarbon types, wt. % by Mass Spec (ASTM D 2789) | |
|---|---|
| Paraffins | 93.1 |
| Mono-cycloparaffins | 5.2 |
| Di-cycloparaffins | 1.5 |
| Alkylbenzenes | 0.1 |
| Benzonaphthalenes | 0.0 |
| Naphthalenes | 0.1 |

| Simulated Distillation, ° F. by wt. %, ASTM D 2887 | |
|---|---|
| 0.5% | 267 |
| 5% | 287 |
| 10% | 310 |
| 20% | 342 |
| 30% | 378 |
| 40% | 405 |
| 50% | 439 |
| 60% | 472 |
| 70% | 504 |
| 80% | 535 |
| 90% | 564 |
| 95% | 579 |
| 99% | 595 |
| 99.5% | 598 |

This sample was mixed with 1-dodecanol in varying amounts and the freeze point was determined. The original sample had a freeze point of −48° C., but adding as little as 0.1 wt. % oxygen as 1-dodecanol significantly increased the freeze point.

Blending of Jet Fuels with 1-Dodecanol for Freeze and Pour Point Measurements

Blending of Jet Fuels with 1-Dodecanol for Freeze and Pour Point Measurements

| | | Fischer-Tropsch Jet Fuel | | | | | | | | |
|---|---|---|---|---|---|---|---|---|---|---|
| Test No | Wt 1-Docecanol, g | Wt Jet Fuel, g | Total Wt in, g | Actual Wt % 1-Dodecanol | Target Wt % 1-Dodecanol | Wt % Oxygen | Jet Freeze by ASTM D5972-99, ° C. | Cloud Point, ° C. | Pour Point, ° C. | Vis at −20 C., cSt |
| 1 | | | | 0 | 0 | 0.00 | −48 | | <−59 | 6.382 |
| 2 | 0.1309 | 10.8550 | 10.9859 | 1.19 | | 0.10 | 0.2 | −8 | | |
| 3 | 0.5910 | 49.4220 | 50.0130 | 1.18 | 1.18 | 0.10 | 0.4 | −9 | −38 | |
| 4 | 0.5878 | 9.5348 | 10.1226 | 5.81 | | 0.50 | 3.1 | 1 | | |
| 5 | 3.0133 | 49.0511 | 52.0644 | 5.79 | 5.79 | 0.50 | 8.8 | 3 | −1 | |

N-paraffin Analysis by GC

| CARBON NUMBER | DISTRIBUTION (Wt. Percent) | NORMAL PARAFFIN | NON N-PARAFFIN |
|---|---|---|---|
| 6 | 0.00 | 0.00 | 0.00 |
| 7 | 0.00 | 0.00 | 0.00 |
| 8 | 0.12 | 0.10 | 0.02 |
| 9 | 8.75 | 1.83 | 6.92 |
| 10 | 10.95 | 1.56 | 9.39 |
| 11 | 11.25 | 1.22 | 10.03 |
| 12 | 11.24 | 1.19 | 10.05 |
| 13 | 11.26 | 0.68 | 10.58 |
| 14 | 10.66 | 0.77 | 9.90 |
| 15 | 10.21 | 0.58 | 9.62 |
| 16 | 9.70 | 0.41 | 9.29 |
| 17 | 9.37 | 0.30 | 9.07 |
| 18 | 6.36 | 0.03 | 6.33 |
| 19 | 0.12 | 0.00 | 0.12 |
| 20 | 0.02 | 0.00 | 0.02 |
| 21 | 0.00 | 0.00 | 0.00 |
| 22-52 | 0.00 | 0.00 | 0.00 |
| TOTAL | 100.00 | 8.67 | 91.33 |
| Average Carbon Number: | | 13.28 | |
| Average Molecular Weight: | | 187.93 | |

For some samples, pour point was also measured.

EXAMPLE 3

An additional jet fuel sample was prepared with a 450° F. end point and a moderate i/n ratio and tested as shown below.

Samples of Fischer Tropsch condensate and wax from a cobalt catalyst were obtained. The condensate was hydrotreated at 3.36 LHSV, 1000 psig total pressure, 5000 SCFB recycle gas rate over a sulfided commercial whole extrudate non-acidic $NiMo/Al_2O_3$ catalyst. The wax was hydrocracked at 1.2 LHSV, 66% per pass conversion below 675° F., 1000 psig total pressure, 5000 SCFB recycle gas rate over a sulfided commercial whole extrudate acidic $NiW/Al_2O_3$—$SiO_2$ catalyst. The products from the two units were continuously blended and distilled. The material boiling above the diesel cut point (roughly 675° F.) was recycled to extinction in the hydrocracker.

The diesel product was further distilled to obtain a 250-400° F. jet fuel fraction with these properties.

| Property | Value | Units |
|---|---|---|
| Density @ 20° C. | 0.7269 | g $cm^{-1}$ |
| Refractive Index @ 20° C. | 1.4096 | |
| Molecular Weight | 142 | Daltons |

-continued

| Property | Value | Units |
|---|---|---|
| n-d-M Analysis | | |
| % Paraffinic Carbon | 98.42 | Wt % |
| % Naphthenic Carbon | 1.52 | Wt % |
| % Aromatic Carbon | 0.00 | Wt % |
| Naphthenic Rings per molecule | 0.03 | |
| Aromatic Rings per molecule | 0.00 | |
| Cloud Point | −60 | ° C. |
| Sulfur | 2.3 | ppm weight |
| Nitrogen | 0.178 | ppm weight |
| Bromine Index | 228 | |
| Aromatics by SFC | | |
| Monoaromatics | <0.5 | Wt % |
| Polyaromatics | <0.5 | Wt % |
| Total Aromatics | <0.5 | Wt % |
| FIAM (D1319) | | |
| Aromatics | 1 | Vol % |
| Olefins | 0 | Vol % |
| Paraffins/Naphthenes | 99 | Vol % |
| n-Paraffin Analysis by Carbon Number | | |
| n-$C_5$ | 0.01 | Wt % |
| n-$C_6$ | 0.01 | Wt % |
| n-$C_7$ | 0.50 | Wt % |

-continued

| Property | Value | Units |
|---|---|---|
| n-$C_8$ | 11.13 | Wt % |
| n-$C_9$ | 16.42 | Wt % |
| n-$C_{10}$ | 16.97 | Wt % |
| n-$C_{11}$ | 13.59 | Wt % |
| n-$C_{12}$ | 0.46 | Wt % |
| n-$C_{13}$ and heavier | 0.00 | Wt % |
| Total Normal Paraffins | 59.09 | Wt % |
| Distilliation by D-2887, Wt % by °F. | | |
| St/ 5 wt % | 196/256 | |
| 10/30 wt % | 260/304 | |
| 50 wt % | 330 | |
| 70/90 wt % | 350/388 | |
| 95/99 wt % | 389/406 | |

These studies show that addition of small amounts of dodecanol has a significant detrimental impact on the jet freeze point. Adding as little as 0.01 wt. % oxygen as 1-dodecanol resulted in freeze points (as measured by ASTM D5972-99, ° C.) well in excess of −47° C. As noted above all wt. % oxygen concentrations are on a water free basis.

Preferred FT Jet Alcohol Compositions with 1-$C_5$ and 1-C7 are Exemplified below.

FT Jet with 1-Heptanol

| Test No | Wt 1-Heptanol, g | Wt Jet Fuel, g | Total wt in, g | Actual wt % 1-Heptanol | Target Wt % 1-Heptanol | Wt % Oxygen | Jet Freeze ° C. | Cloud Point, ° C. |
|---|---|---|---|---|---|---|---|---|
| 6 | 0 | | | No added alcohol | | 0 | −56.9 | −60 |
| 7 | 0.00597 | 8.49875 | 8.50472 | 0.07 | 0.0725 | 0.01 | −59 | −61.6 |
| 8 | 0.03208 | 4.38771 | 4.41979 | 0.73 | 0.725 | 0.10 | −50 | −58.8 |

FT Jet with 1-Pentanol

| Test No | Wt 1-Pentanol g | Wt Jet Fuel, g | Total wt in, g | Actual wt % 1-Pentanol | Target Wt % 1-Pentanol | Wt % Oxygen | Jet Freeze ° C. | Cloud Point, ° C. |
|---|---|---|---|---|---|---|---|---|
| 9 | 0.00315 | 6.00633 | 6.00948 | 0.05 | 0.055 | 0.01 | −56.6 | −61.6 |
| 10 | 0.03231 | 6.02061 | 6.05292 | 0.53 | 0.55 | 0.10 | −59.1 | −55.8 |

FT Jet with 1-Dodecanol

| Test No | Wt 1-Docecanol, g | Wt Jet Fuel, g | Total wt in, g | Actual wt % 1-Dodecanol | Target Wt % 1-Dodecanol | Wt % Oxygen | Jet Freeze ° C. | Cloud Point, ° C. |
|---|---|---|---|---|---|---|---|---|
| 11 | 0.01050 | 9.00597 | 9.01647 | 0.116 | 0.11625 | 0.01 | −21 | −37 |
| 12 | 0.06792 | 6.00194 | 6.06986 | 1.119 | 1.1625 | 0.10 | −2 | −11 |

FT Jet with 1-Decanol

| Test No | Wt 1-Decanol, g | Wt Jet Fuel, g | Total wt in, g | Actual wt % 1-Decanol | Target Wt % 1-Decanol | Wt % Oxygen | Jet Freeze ° C. | Cloud Point, ° C. |
|---|---|---|---|---|---|---|---|---|
| 13 | 0.0233 | 23.9778 | 24.0011 | 0.10 | 0.09875 | 0.01 | −56 | −52 |

FT Jet with 1-Octanol

| Test No | Wt 1-Decanol, g | Wt Jet Fuel, g | Total wt in, g | Actual wt % 1-Decanol | Target Wt % 1-Decanol | Wt % Oxygen | Jet Freeze ° C. | Cloud Point, ° C. |
|---|---|---|---|---|---|---|---|---|
| 14 | 0.00331 | 4.00237 | 4.00568 | 0.083 | 0.08125 | 0.01 | −57.1 | −60.7 |
| 15 | 0.08838 | 10.93777 | 11.02615 | 0.802 | 0.8125 | 0.10 | −53 | −61 |

This examples illustrate the inability to get low pour and cloud points with normal alcohols such as 1-dodecanol while $C_8$ and $C_{10}$ normal alcohols can be employed and obtain a low freeze point, especially when the distilled fraction has a lower end point than the prior example and a moderate i/n ratio. The range of $C_5$ to $C_7$ alcohols are most preferred to get a low freeze point and also obtain an MSEP of 85 or higher as measured by ASTM 3948.

What is claimed is:

1. A Fischer-Tropsch derived distillate suitable for use as a turbine fuel having a flash point 38° C. minimum measured by ASTM D 56, a freeze point of −40° C. or less, and further containing no less than about 0.01 wt% oxygen in each of 1-pentanol, 1-hexanol, and 1-heptanol and not more than about 0.01 wt% oxygen in $C_{8+}$ linear alcohols selected from the group consisting of $C_8$, $C_9$, and $C_{10}$ and mixtures thereof alcohols and further wherein the iso- to normal paraffins are at least 90% iso-paraffins and the cut point is less than 450° F.

2. The Fischer-Tropsch derived distillate of claim 1 wherein the freeze point is −47° C.

3. The Fischer-Tropsch derived distillate of claim 2 wherein the freeze point is −50° C. or less.

4. The Fischer-Tropsch derived distillate of claim 1 wherein the sum of the oxygenate content of the $C_5$-$C_7$ linear alcohols present are within the range of from about 0.01 wt. % oxygen and about 1 wt. % oxygen.

5. The Fischer-Tropsch derived distillate of claim 4 wherein the alcohol is any two of the $C_5$-$C_7$ linear alcohols in a total concentration less than 1 wt. % oxygen.

6. The Fischer-Tropsch derived distillate according to claim 5 selected from the group consisting of $C_5$ and $C_6$; $C_5$ and $C_7$; or $C_6$ and $C_7$.

7. The Fischer-Tropsch distillate of claim 1 wherein the MSEP as measured by ASTM D 3948 is 85 or higher.

8. The Fischer-Tropsch derived distillate of claim 1 wherein the alcohol is any two of the $C_5$-$C_7$ linear alcohols in a total concentration less than 1 wt. % oxygen.

9. A process for preparing a Fischer-Tropsch derived turbine fuel which comprises:

(a) separating a Fischer-Tropsch condensate into a first and second fraction, wherein:

(i) said first fraction comprises not less than about 0.01 wt. % oxygen each of 1-pentanol, 1-hexanol, and 1-heptanol and not more than about 0.01 wt. % oxygen in $C_{8+}$ linear alcohols and (ii) said second fraction comprises $C_{8+}$ linear alcohols;

(b) removing the $C_{8+}$ linear alcohols from at least a portion of said second fraction and recovering a treated heavy fraction substantially free of $C_{8+}$ linear alcohols; and (c) blending at least a portion of the first fraction of step a(i) and a portion of the treated heavy fraction of step (b) in the proper proportion to prepare a Fischer-Tropsch derived turbine fuel wherein the sum of the oxygenate content of the $C_5$-$C_7$ alcohols present are within the range of from about 0.01 wt.% oxygen and about 1 wt. % oxygen, the freeze point is not more than −40° C., and the flash point 38° C. minimum measured by ASTM D 56, and wherein the first fraction further includes $C_{8+}$ linear alcohols selected from the group consisting of $C_8$, $C_9$ and $C_{10}$ and mixtures thereof alcohols and step b removes the $C_{11+}$linear alcohols from at least a portion of said second fraction and recovering a treated heavy fraction substantially free of $C_{11+}$ linear alcohols and step(c) blends at least a portion of the first fraction of step a(i) and a portion of the treated heavy fraction of step (b).

10. The process of claim 9 wherein the first fraction and the second fraction are blended in step (c) with the proper proportion to prepare a Fischer-Tropsch derived turbine fuel having a freeze point of not more than −47° C.

11. The process of claim 9 wherein the first fraction and the second fraction are blended in step (c) with the proper proportion to prepare a Fischer-Tropsch derived turbine fuel having a freeze point of not more than −50° C.

12. The process of claim 9 wherein the second fraction is treated by a process selected from hydrotreating, hydrocracking, hydroisomerization, dehydration, adsorption, absorption, or a combination thereof to obtain the treated heavy fraction substantially free of $C_{8+}$ linear alcohols.

13. In a jet fuel having a freeze point of −40° C. or less, the improvement comprising not less than about 0.01 wt.% oxygen in each of 1-pentanol, 1-hexanol, and 1-heptanol and not more than about 0.01 wt. % oxygen in $C_{8+}$ linear alcohols selected from the group consisting of $C_8$, $C_9$ and $C_{10}$ and mixtures thereof alcohols and wherein the iso to normal paraffins are at least 90% i-paraffins. and the cut point is less than 450° F.

14. The jet fuel of claim 13 wherein the freeze point is −47° C.

15. The jet fuel of claim 14 wherein the freeze point is −50° C. or less.

16. The jet fuel of claim 13 wherein the sum of the oxygenate content of the $C_5$-$C_7$ linear alcohols present are within the range of from about 0.01 wt. % oxygen and about 1 wt. % oxygen.

17. The jet fuel of claim 16 wherein the alcohol is any two of the $C_5$-$C_7$ linear alcohols in a total concentration less than 1 wt.% oxygen.

18. The jet fuel of claim 13 wherein the MSEP as measured by ASTM D 3948 is 85 or higher.

19. The jet fuel of claim 13 wherein the alcohol is any two of the $C_5$-$C_7$ linear alcohols in a total concentration less than 1 wt. % oxygen.

20. A process for preparing a Fischer-Tropsch derived turbine fuel which comprises:

(a) separating a Fischer-Tropsch condensate into a first, a second, and a third fraction, wherein:

(i)said first fraction comprises not less than about 0.01 wt. % oxygen each of 1-pentanol, 1-hexanol, and 1-heptanol and not more than about 0.01 wt. % oxygen in $C_{8+}$ linear alcohols, (ii) said second fraction comprises $C_{8+}$ linear alcohols, and (iii) said third fraction comprises $C_{4+}$ linear alcohols; and (b) removing the $C_{8+}$ linear alcohols from at least a portion of said second fraction and recovering a treated heavy fraction substantially free of $C_{8+}$ linear alcohols; and (c) blending at least a portion of the first fraction of step a(i) and a portion of the treated heavy fraction of step (b) in the proper proportion to prepare a Fischer-Tropsch derived turbine fuel wherein the sum of the oxygenate content of the $C_5$-$C_7$ alcohols present are within the range of from about 0.01 wt. % oxygen and about 1 wt. % oxygen, the freeze point is not more than −40° C., and the flash point 38° C. minimum measured by ASTM D 56.

* * * * *